US009956567B2

(12) United States Patent
Albrecht et al.

(10) Patent No.: US 9,956,567 B2
(45) Date of Patent: May 1, 2018

(54) SYSTEM FOR COATING, IN PARTICULAR FOR PAINTING, ARTICLES, IN PARTICULAR VEHICLE BODIES

(75) Inventors: Markus Albrecht, Abstatt (DE); Frank Tietze, Bietigheim-Bissingen (DE)

(73) Assignee: EISENMANN SE, Boeblingen, DE (US)

( * ) Notice: Subject to any disclaimer, the term of this patent is extended or adjusted under 35 U.S.C. 154(b) by 374 days.

(21) Appl. No.: 14/122,718

(22) PCT Filed: May 23, 2012

(86) PCT No.: PCT/EP2012/002185

§ 371 (c)(1),
(2), (4) Date: Apr. 10, 2014

(87) PCT Pub. No.: WO2012/163491

PCT Pub. Date: Dec. 6, 2012

(65) Prior Publication Data

US 2014/0245953 A1 Sep. 4, 2014

(30) Foreign Application Priority Data

Jun. 1, 2011 (DE) ..... 10 2011 103 117

(51) Int. Cl.
*B05B 15/02* (2006.01)
*B05B 15/12* (2006.01)
(Continued)

(52) U.S. Cl.
CPC ..... *B05B 15/0258* (2013.01); *B05B 15/025* (2013.01); *B05D 3/12* (2013.01);
(Continued)

(58) Field of Classification Search
None
See application file for complete search history.

(56) References Cited

U.S. PATENT DOCUMENTS 5,125,979 A * 6/1992 Swain et al. ..... 134/7
6,217,944 B1 4/2001 Yoshida et al.
(Continued)

FOREIGN PATENT DOCUMENTS

DE 297 06 320 U1 6/1997
DE 102 40 073 A1 12/2003
(Continued)

OTHER PUBLICATIONS

Motschmann et al, CO2 Blasting in Machine and Equipment Technology, 2010.*
(Continued)

*Primary Examiner* — Jethro M Pence

(57) ABSTRACT

A system for coating articles which includes a coating booth, a conveyor system, which guides the articles through the coating booth, and at least one application unit, which is carried and guided by a handling device. A central supply unit having a tank for storing $CO_2$ in liquid or solid form and which is able to remove $CO_2$ from the tank and supply it at a suitable pressure to a collecting line connected to at least one cleaning apparatus, which includes at least one nozzle of suitable design for delivering $CO_2$ for cleaning purposes. Under program control a relative movement between the nozzle and the application unit is induced, such that all surfaces of the application unit to be cleaned can be reached by $CO_2$.

15 Claims, 5 Drawing Sheets

(51) Int. Cl.

| | |
|---|---|
| ***B05D 3/12*** | (2006.01) |
| ***B05D 7/14*** | (2006.01) |
| ***B24C 1/00*** | (2006.01) |
| ***B24C 3/08*** | (2006.01) |
| *B05D 3/04* | (2006.01) |

(52) U.S. Cl.
CPC ..... *B05D 7/14* (2013.01); *B24C 1/003* (2013.01); *B24C 3/08* (2013.01); *B05B 15/1288* (2013.01); *B05D 3/0466* (2013.01)

(56) References Cited

U.S. PATENT DOCUMENTS

| | | | |
|---|---|---|---|
| 2008/0251011 | A1 | 10/2008 | Albrecht |
| 2009/0197512 | A1 | 8/2009 | Moller et al. |

FOREIGN PATENT DOCUMENTS

| | | | | |
|---|---|---|---|---|
| DE | 10 2004 040 161 | A1 | 3/2006 | |
| DE | 698 38 942 | T2 | 1/2009 | |
| DE | 10 2008 059 764 | A1 | 10/2009 | |
| DE | 10 2009 016 116 | A1 | 10/2010 | |
| FR | 2 912 072 | A1 | 8/2008 | |
| FR | 2912072 | A1 * | 8/2008 | ..... B05D 3/12 |
| WO | 2006034824 | A2 | 4/2006 | |

OTHER PUBLICATIONS

Motschmann et al., CO2—Strahlen in Maschinenund Anlagentechnik, Elektroprakitker, Berlin 64 (2010).

* cited by examiner

SYSTEM FOR COATING, IN PARTICULAR FOR PAINTING, ARTICLES, IN PARTICULAR VEHICLE BODIES

RELATED APPLICATIONS

This application is a national phase of International Patent Application No. PCT/EP2012/002185, filed on May 23, 2012, which claims the filing benefit of German Patent Application No. 10 2011 103 117.4, filed on Jun. 1, 2011, the contents of both of which are incorporated herein by reference.

FIELD OF THE INVENTION

The invention relates to a system for coating, in particular painting, objects, in particular vehicle bodies, having a) a coating booth;

b) a conveying system which guides the objects to be coated through the coating booth;

c) at least one application unit for the coating medium;

d) at least one handling device, in particular a robot, which carries and guides the application unit.

BACKGROUND OF THE INVENTION

In the automatic coating of objects, in particular when painting vehicle bodies, not all of the coating medium exiting the application units lands on the object to be coated. Instead, so-called "overspray" is produced, the majority of which is discharged from the coating booth with the aid of an air flow and a relatively small proportion of which deposits on inner surfaces of the coating booth, but preferably on the outer surfaces of the application units and the adjacent regions of the handling device. The deposits have to be removed from these outer surfaces at regular intervals.

To facilitate this, previous practice has frequently been to provide the outer surface of the application unit with a protective film, for example of Vaseline, from the atomising region up to its mounting point on the handling device, i.e. in the case of a robot, for example, up to the wrist joint. This protective film then has to be removed manually from time to time and disposed of together with the deposited paint.

It is known in other fields of the technology to clean surfaces with the aid of $CO_2$. This is advantageous in that the cleaned surfaces do not have to be additionally dried since the $CO_2$ used for drying changes directly into the gaseous form by sublimation.

An object of the present invention is to provide a system of the type mentioned at the outset in which the cleaning of the application unit and adjacent regions can take place in as automated a manner as possible with relatively low material costs and relatively little manual effort.

SUMMARY OF THE INVENTION

This object may be achieved according to the invention in that the system comprises:

e) at last one cleaning device, which has at least one nozzle from which $CO_2$ can exit in a form suitable for cleaning purposes, in particular as $CO_2$ snow or in the form of pellets, and can be applied to the surfaces of the application unit which are to be cleaned and possibly adjacent regions of the handling device;

f) a tank for storing $CO_2$ in liquid or solid form;

g) a central supply unit which in turn has conveying means which are able to remove $CO_2$ from the tank and supply it at a pressure suitable for further conveying;

h) a collecting line, which is connected to the supply unit and attached to the at least one cleaning device;

wherein i) under program control, a relative movement between the nozzle and the application unit can be induced in such a way that all surfaces of the application unit which are to be cleaned can be reached by the $CO_2$ exiting the nozzle.

With the present invention, the cleaning of the outer surfaces of the application unit can be fully automated in a manner similar to that which is already possible for cleaning the inner flow paths of the application device with solvent. Therefore, total cleaning of the application units in the coating booth can be carried out in a much shorter time without the use of workers; entry into the coating booth is generally no longer required. The necessary movements of the application unit and/or nozzle are effected here with the interaction between the central system control and possibly the individual controls associated with the handling devices and/or the cleaning devices.

Compared with the use of protective films, the use of chemicals is reduced by the invention, thereby lowering the disposal costs at the same time. The application of a protective film is dispensed with, which, on the one hand, eliminates the production stops caused thereby and, on the other, no longer exposes the workers assigned thereto to the atmosphere in the coating booth. Cleaning with the aid of $CO_2$ snow can also be carried out at sensitive points where cleaning agents which are otherwise applied cannot be used.

The $CO_2$ used for cleaning purposes can come from conventional sources, for example from pressure cylinders, which are connected to the supply system; alternatively, the tank of the central supply unit can also be connected directly to a $CO_2$ retrieval or supply system.

Depending on the form of the $CO_2$ to be applied to the surfaces to be cleaned, the tank can be constructed to store liquid or solid $CO_2$. Solid $CO_2$ can already be present in the tank in the form of pellets which can be conveyed through the collecting line with the aid of an appropriate air flow.

It is alternatively also possible for the solid $CO_2$ to be present in the form of a block and to provide a comminution device which is able to shave small parts from the block. In this design, the loss of $CO_2$ by sublimation is less than for the supply of pellets.

If liquid $CO_2$ is used, then the collecting line preferably comprises a line for liquid $CO_2$ and a line for atomising compressed air and is connected to at least one two-component nozzle for generating $CO_2$ snow. The $CO_2$ snow is therefore produced only as it exits the corresponding nozzle.

The nozzle of the cleaning device can be pivotally mounted on a holder, for which a corresponding drive—motor drive or pneumatic drive—can generally be provided. This enables the required relative movement between the nozzle and the application unit to take place in part by moving the nozzle.

The cleaning device preferably comprises a plurality of nozzles from which the application unit can be acted upon from different angles. The use of a plurality of nozzles reduces the extent of the relative movement between the nozzle and application unit required for cleaning all the surface regions.

It is further expedient if the collecting line is connected to at least one discharge point to which a manual cleaning device can be attached. This manual cleaning device is then used by way of exception when automatic cleaning of the application unit by the cleaning device is insufficient, or for cleaning other surfaces inside the coating booth on which a deposit has formed.

In an advantageous embodiment of the invention, the cleaning device has a housing which has at least one opening through which the application unit can be introduced into the interior of the housing. This enables the cleaning process to be substantially shielded from the other regions of the coating booth.

It is finally expedient if the cleaning device has an enclosed space into which the delivery end of the application unit can be introduced through an opening for rinsing the inner flow paths with solvent. This enables the outer surface to be cleaned at substantially the same time as the cleaning of the inner flow paths of the application unit takes place, which means that the idle times of the system can be further reduced.

It is to be understood that the aspects and objects of the present invention described above may be combinable and that other advantages and aspects of the present invention will become apparent upon reading the following description of the drawings and detailed description of the invention.

BRIEF DESCRIPTION OF THE DRAWINGS

Exemplary embodiments of the invention are explained in more detail below with reference to the drawing; which shows FIG. 1 a schematic illustration of a detail of the layout of a paint booth.

DETAILED DESCRIPTION OF THE PRESENT INVENTION

Figure 1:
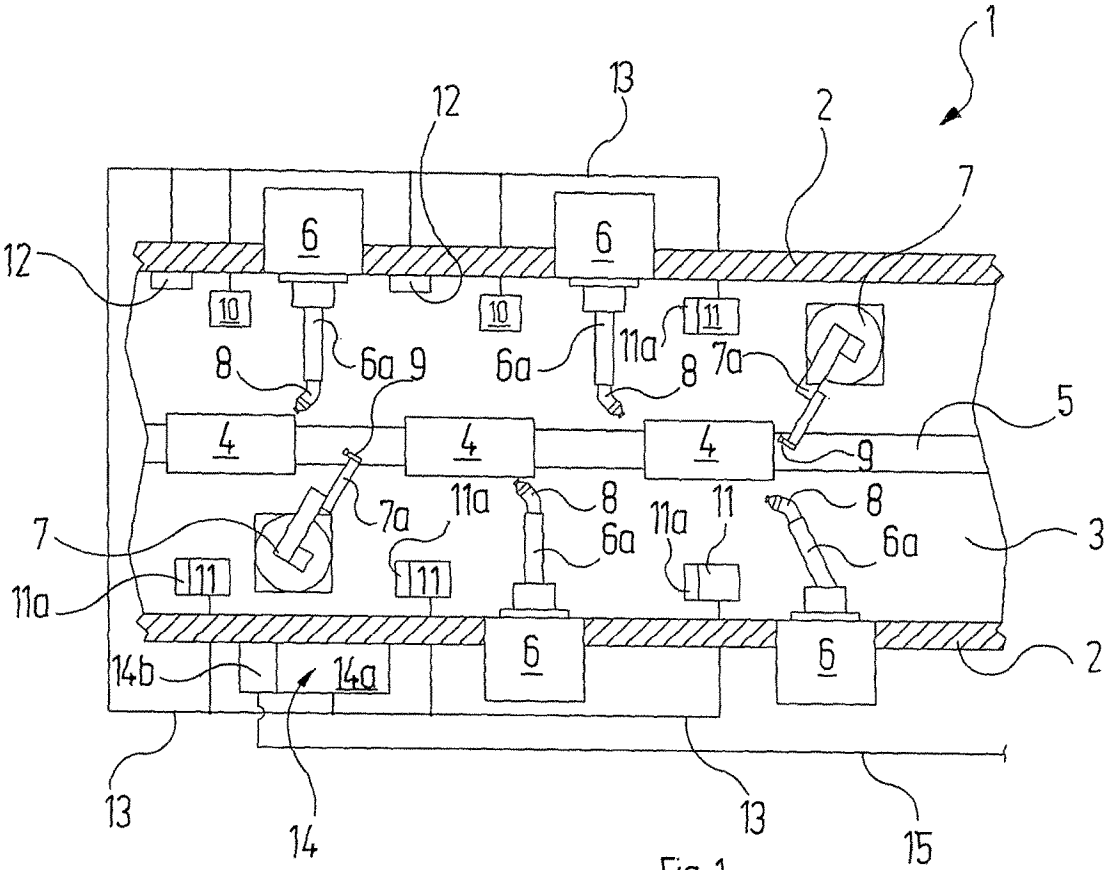

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

Reference is firstly made to FIG. 1. This can be seen as a schematic layout of part of a paint booth or as a horizontal section through the paint booth below its ceiling. The paint booth, which is provided as a whole with the reference numeral 1, comprises two parallel side walls 2 which are closed in the region which is not shown further by end walls which, in known manner, in turn have gates or locks for the objects 4 to be painted. The floor of the paint booth 1 is substantially formed by a grid 3, whilst it is substantially closed to the top, likewise in conventional manner, by an air plenum from which conditioned air can be conducted into the interior of the paint booth 1.

The objects 4 to be painted, which are shown schematically as rectangles in the drawing and which, in particular, can be vehicle bodies or parts thereof, are guided in a continuous or intermittent movement through the interior of the paint booth 1, for example from left to right in FIG. 1, with the aid of a conveying system 5. The type of conveying system 5 is not of interest in the present connection.

Paint-spray robots 6, 7 are arranged on both sides of the movement path of the objects 4 on the conveying system 5. It is also possible to use different designs here. Merely by way of example, a total of four articulated robots 6 are provided, of which two are arranged in each case on one side of the movement path of the objects 4, and two industrial robots 7, of which one is arranged in each case on one side of the movement path. Common to both robot types is that they have a movable robot arm 6*a* and 7*a*, at the end of which a respective application unit 8 and 9 is supported in each case. Each of these application units 8, 9 comprises the actual applicator, which can refer in particular to spray pistols and/or high rotation atomisers.

A plurality of cleaning stations 10, 11, which are shown schematically as rectangles, is provided along the side walls 2 of the paint booth 1. Common to the cleaning stations 10, 11 is that they contain at least one nozzle from which $CO_2$ in the form of solid pellets or snow can exit. Details relating to possible designs of such cleaning stations 10, 11 are described further below with reference to FIGS. 2 to 5.

Provided on the upper side wall 2 of the paint booth 1 in FIG. 1, apart from the cleaning stations 10, 11, there are discharge points 12 for attaching manual cleaning devices, i.e. cleaning devices whereof the nozzles, contrary to those of the cleaning stations 10, 11, are not guided automatically by robots according to particular programs, but by hand.

All the discharge stations 10, 11, 12 are connected to a collecting line 13 by way of branch lines which are not provided with reference numerals for the sake of clarity. This collecting line leads to a central supply unit 14 which, in the exemplary embodiment of FIG. 1, is joined to the lower side wall 2 from the outside. The central supply unit 14 has a region 14*a* in which all the assemblies, pumps and valves required for conveying $CO_2$ in pellets or in liquid form, as well as associated controls, are accommodated. The provision of auxiliary media, for example compressed air and conveying air, as required for transporting $CO_2$ particularly in pellet form or for generating $CO_2$ snow, takes place in the region 14*a* of the central supply unit 14.

The latter moreover comprises a tank 14*b* in which the $CO_2$ used for cleaning is held in the form of pellets or in liquid form. Instead of pellets, it is also possible to use a large solid $CO_2$ block from which relative small solid particles are then shaved as required in a size suitable for transportation through conduits.

The tank 14*b* is in communication with an external $CO_2$ source by way of a line 15. This source can be a conventional pressure cylinder or any other source of $CO_2$.

If gaseous $CO_2$ is supplied, it goes without saying that the assemblies and devices necessary for liquefaction or solidification also have to be present in the central supply unit 14.

The cleaning stations 10, 11 have a housing 16 which has an opening such that the application units 8, 9 of the associated robots 6, 7 can be introduced into the interior of the corresponding cleaning device 10, 11. In general, this means an opening to the top and possibly also to at least one side. Examples of this are described further below.

The paint booth 1 described above operates as follows:

The normal painting procedure proceeds in conventional manner:

The objects 4 to be painted, which are prepared accordingly, are supplied from the left in FIG. 1 with the aid of the conveying system 5 and thereby arrive in the region of the application devices 8 and 9 guided by the robots 6, 7. According to predetermined movement programs under the command of the system control and the individual robot controls, the objects 4 are sprayed with paint from the application units 8, 9. When they leave the paint booth 1 to the right in FIG. 1, they are fully painted or at least one painting phase is complete.

The overspray produced during the painting procedure is substantially entrained in the air flow, which flows through the paint booth 1 from top to bottom, starting from the above-mentioned air plenum and through the grid 3 forming the floor of the paint booth 1. However, some of the overspray deposits on the outer surfaces of the robot arms 6*a*, 7*a* and the application units 8, 9. This has to be removed from there again at certain intervals, depending on the level of contamination. This now takes place in the following manner:

It is assumed that the tank 14*b* of the central supply unit 14 is filled with liquid $CO_2$ by way of the line 15. The region 14*a* of the central supply unit 14 has filled the collecting line 13 with the required liquid $CO_2$ and atomising compressed air. In this case, the collecting line 13 comprises separate individual lines which lead to the respective discharge point 10, 11, 12. Liquid $CO_2$ or atomising compressed air is now available at these discharge stations 10, 11, 12. For cleaning purposes, the application units 8, 9 and those regions of the robot arms 6*a*, 7*a* which are adjacent thereto are now guided through the above-mentioned openings, again under program control, into the housings of the cleaning stations 10, 11.

The valves there are now opened so that liquid $CO_2$ and atomising compressed air can flow into the corresponding two-component nozzles and form $CO_2$ snow there. This snow is applied to the surface regions of the application units 8, 9 and, if dirty, the adjacent regions of the robot arms 6*a*, 7*a*. During this, as explained in more detail below, the nozzles can be pivoted by a motor, again under program control, to reach all surfaces to be cleaned. This releases the dirt, as is known per se in $CO_2$ cleaning processes.

The application units 8, 9 are then moved back out of the housings of the cleaning stations 10, 11 with the aid of the associated robot arms 6*a*, 7*a;* remaining surfaces which have not been fully cleaned can be post-cleaned as required with the aid of the manual cleaning devices 11*a*, 12.

The paint operation can then be re-started without delay, without those surface regions of the application units 8, 9 or adjacent regions of the robot arms 6*a*, 7*a* which are to be cleaned of paint needing to be dried or subjected to some other post-treatment.

Figure 2:
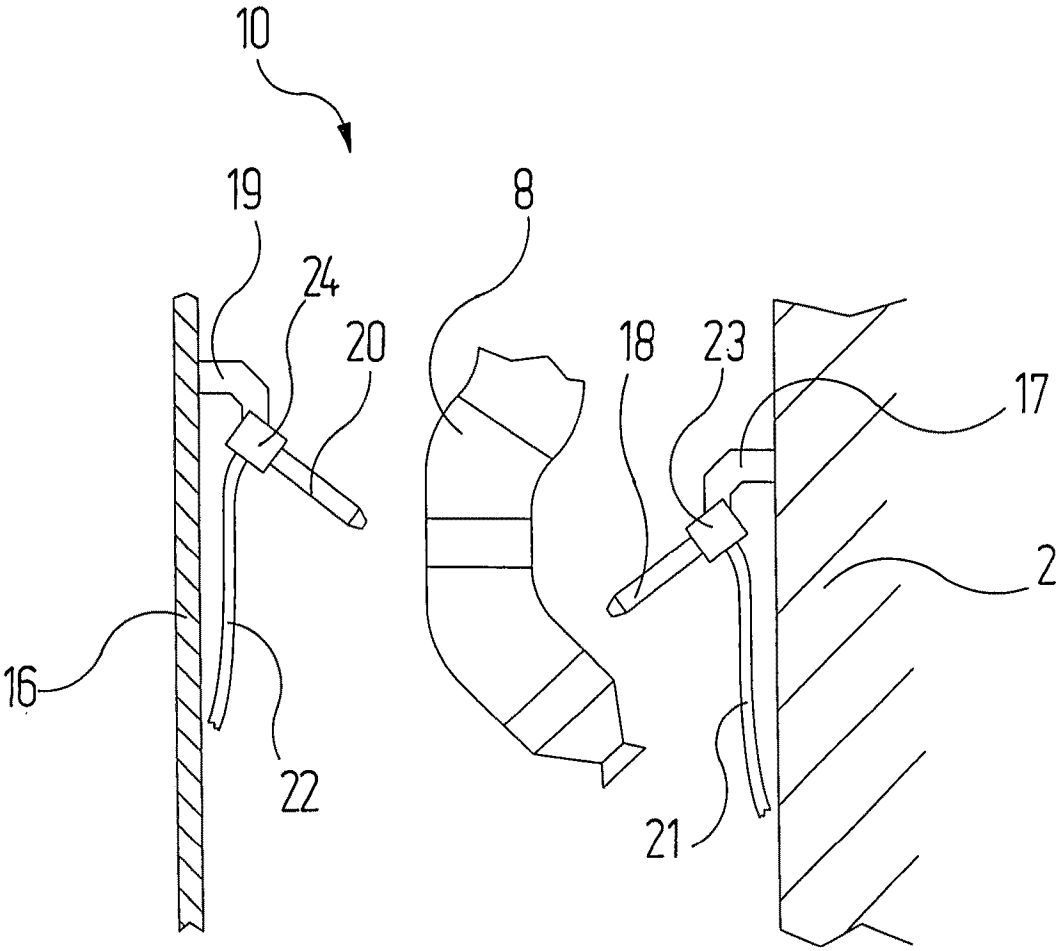
FIGS. 2 to 5 schematic illustrations, shown in vertical and horizontal section, of cleaning stations as can be used in the paint booth of FIG. 1.

FIG. 2 shows a schematic illustration of a cleaning station 10 in vertical section. This shows a portion of the booth wall 2, a portion of the opposing wall of the housing 16, a two-component nozzle 18 which is mounted on the booth wall 2 by means of a holder 17 and a two-component nozzle 20 which is mounted on the housing wall 16 by means of a holder 19. The two-component nozzles 18, 20 are supplied with liquid $CO_2$ and atomising compressed air by way of supply hoses 21, 22 which are connected to the collecting line 13. The two-component nozzles 18, 20 can be pivoted by a motor or pneumatically about a horizontal axis 23, 24 under the influence of the system control.

The application unit 8 of an articulated robot 6 is introduced from above between the housing wall 16 and the booth wall 2 in FIG. 2. During cleaning of the introduced region of the application unit 8 and possibly the adjoining region of the associated robot arm 6*a*, the two-component nozzles 18, 20 generate $CO_2$ snow and apply this to the surfaces to be cleaned. To reach all the surfaces, the two-component nozzles 18, 20 are pivoted here about the above-mentioned axes 23, 24. It is also optionally possible for the application unit 8 to be additionally rotated about a vertical axis.

After completion of this cleaning work, the application unit 8 is withdrawn from the cleaning station 10 from above by means of the associated robot arm 6*a*.

Figure 3:
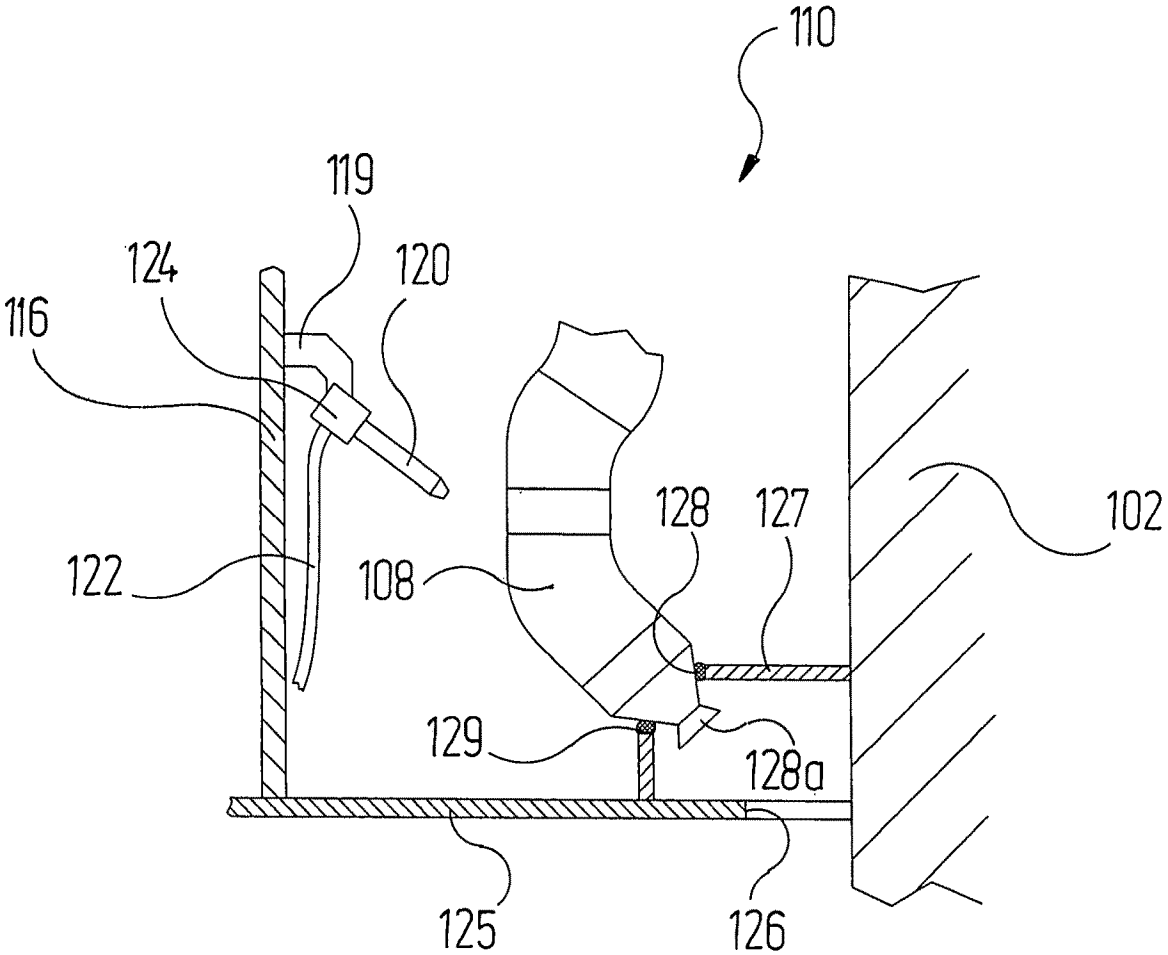

FIG. 3 shows, likewise in vertical section, a variant of the cleaning station 10 of FIG. 2. Corresponding parts are here denoted by the same reference numerals as in FIG. 2, but increased by 100. The booth wall 102 and the housing wall 116 can both be seen. A base wall 125 of the cleaning station 110, in which an outlet opening 126 is located, is additionally shown in this exemplary embodiment. Provided above the outlet opening 126, there is a cleaning box 127 which surrounds a substantially closed space and has an opening 128 which points obliquely upwards and inwards into the cleaning device 110 and is surrounded by a seal 129.

In the cleaning device 110 illustrated in FIG. 3, a two-component nozzle 120, which is supplied with liquid $CO_2$ and atomising air by way of the hose 122, is provided only on the housing wall 116.

For cleaning purposes, the application unit 108 is led through the opening 128 into the box 127 by its front-most end, which has the actual atomising region 108*a*. Whilst the outer surfaces of the application unit 108 are cleaned in the manner described above by means of the two-component nozzle 120, the inner flow paths of the application unit 108 are cleaned with a solvent which is sprayed via the atomising region 128*a* into the interior of the box 127 and ultimately removed by way of the outlet opening 126. The outer surfaces are thus cleaned at the same time as the inner flow paths of the application unit 108.

Figure 4:
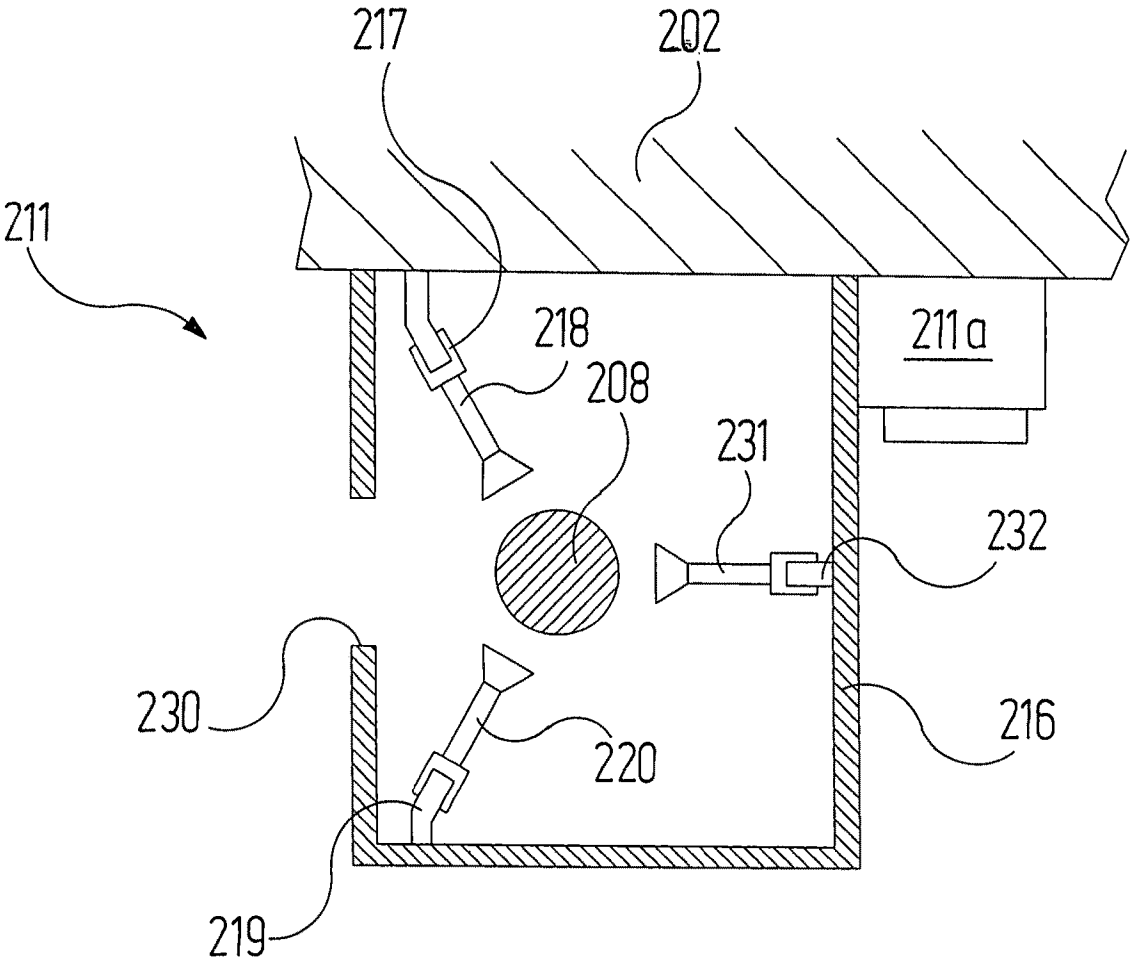

A further exemplary embodiment of a cleaning device 210 is shown in horizontal section in FIG. 4. Parts which correspond to those of the cleaning device of FIG. 2 are provided with the same reference numerals increased by 200. The housing 216 of the cleaning device 210 is placed on the booth wall 202. This housing is open to the top and additionally has an opening 230 in one of the side walls. A respective two-component nozzle 218, 220, 231 is mounted on the booth wall 202 and on those side walls of the housing 216 which do not have an opening. The nozzles 218, 220, 231 each include an angle of 120° here.

The applicator 208 of an articulated robot is introduced from above and/or through the opening 230 in the housing 216 into the interior thereof in the position shown in FIG. 4 in the centre between the atomising regions of the two-component nozzles 218, 220, 231. The application unit 208 can be acted upon here from three sides by $CO_2$ snow. Under favourable circumstances, it is thus possible to reach all surface regions of the application unit 208 without this having to be additionally rotated.

In FIG. 4, a discharge point 211*a* for a manual cleaning device (not illustrated itself) is shown placed on the cleaning station 211.

Figure 5:
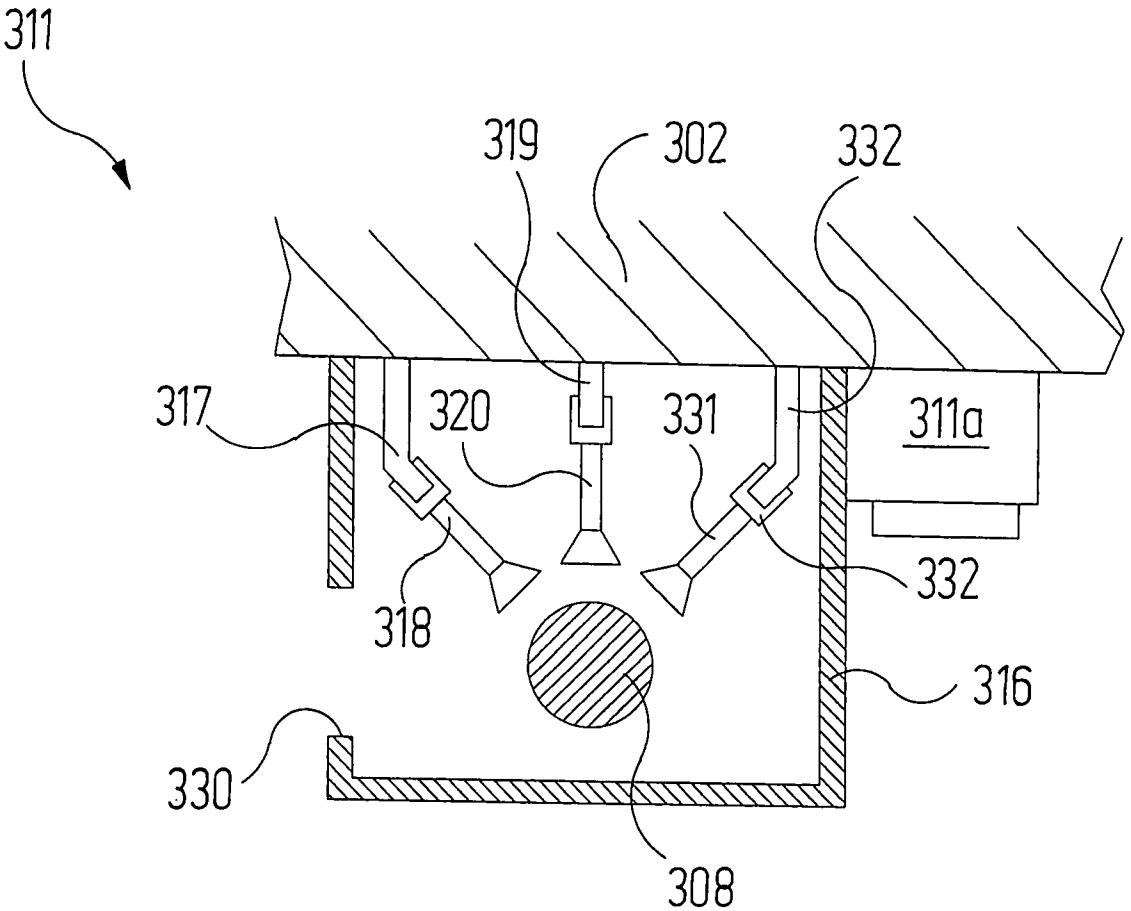

FIG. 5 finally shows, likewise in a horizontal section, a cleaning station 311 which corresponds substantially to that of FIG. 4 and whereof the parts are denoted by reference numerals which are again increased by 100. The booth wall 302, the housing 316 and the opening 230 thereof resemble the corresponding components in the exemplary embodiment of FIG. 4 and therefore do not need to be described again. The main difference between the exemplary embodiments of FIGS. 5 and 4 is that, in the exemplary embodiment of FIG. 5, all three two-component nozzles 318, 320 and 331 are mounted on the booth wall 302. In this design, it will generally be necessary to rotate the application unit 308 to be cleaned during the cleaning process so that $CO_2$ snow reaches all surface regions.

In the above description of the different exemplary embodiments of cleaning devices 10, 11; 110; 211; 311 it was assumed that cleaning took place using $CO_2$ snow. However, the cleaning process proceeds in substantially the same manner if $CO_2$ pellets are used instead of $CO_2$ snow. These pellets are guided through the supply line 13 to the various discharge points 10, 11, 12 with the aid of transport air. Owing to the mechanical impact of the pellets against the surfaces to be cleaned, their cleaning action is known to be somewhat greater; however cleaning with $CO_2$ foam is gentler.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. A system for coating comprising:

a) a coating booth;

b) a conveying system which guides objects to be coated through the coating booth;

c) at least one application unit for a coating medium;

d) at least one handling device which carries and guides the at least one application unit;

e) at least one cleaning device which has at least one nozzle from which carbon dioxide ($CO_2$) exits for cleaning purposes, the at least one nozzle being aimed at the at least one application unit;

f) a tank for storing the $CO_2$ in a liquid form or a solid form;

g) a central supply unit, which has a conveying means which remove the $CO_2$ from the tank and supply the $CO_2$ at a pressure for further conveying;

h) a collecting line which is connected to the central supply unit and attached to the at least one cleaning device;

i) a controller configured to control relative movement between the at least one nozzle and the at least one application unit to re-aim the at least one nozzle to direct the $CO_2$ at different portions of the at least one application unit so that all surfaces of the at least one application unit which are cleaned are reached by the $CO_2$ exiting the at least one nozzle.

2. The system according to claim 1, wherein the tank of the central supply unit is filled by way of a supply line which is connected to pressure cylinders or a $CO_2$ retrieval or supply system.

3. The system according to claim 1, wherein the tank is constructed to store the liquid form $CO_2$.

4. The system according to claim 1, wherein the tank is constructed to store the solid form $CO_2$.

5. The system according to claim 4, wherein the solid form $CO_2$ is in a form of pellets.

6. The system according to claim 4, wherein the solid form $CO_2$ is in a form of a block and wherein the system further comprises a comminution device to shave small parts from the block.

7. The system according to claim 1, wherein the collecting line comprises a line for the liquid form $CO_2$ and a line for atomising compressed air and is connected to at least one two-component nozzle for generating $CO_2$ snow.

8. The system according to claim 1, wherein the at least one nozzle is pivotally mounted on a holder.

9. The system according to claim 1, wherein the at least one cleaning device has a plurality of nozzles from which the application unit is acted upon from different angles.

10. The system according to claim 1, wherein the collecting line is connected to at least one discharge point to which a manual cleaning device is attached.

11. The system according to claim 1, wherein the at least one cleaning device has a housing which has at least one opening through which the at least one application unit is introduced into the interior of the housing.

12. The system according to claim 1, wherein the at least one cleaning device has a closed space into which a delivery end of the at least one application unit is introduced through an opening to rinse the inner flow paths with solvent.

13. The system according to claim 1, wherein the $CO_2$ exiting the at least one nozzle of the at least one cleaning device is snow or in a form of pellets.

14. The system according to claim 1, wherein the at least one nozzle is aimed at adjacent regions of the at least one handling device.

15. A method for operating a system for coating comprising the steps of:

a) guiding objects to be coated through a coating booth using a conveying system;

b) carrying and guiding at least one application unit with at least one handling device, wherein the at least one application unit supplies a coating medium to the objects guided through the coating booth;

c) storing carbon dioxide ($CO_2$) in a liquid form or a solid form in a tank;

d) removing the $CO_2$ from the tank using a central supply unit having a conveying means and supplying the $CO_2$ at a pressure for further conveying;

e) connecting a collecting line between the central supply unit and at least one cleaning device;

f) aiming at least one nozzle of the at least one cleaning device at the at least one application unit;

g) applying the $CO_2$ for cleaning purposes to a surface of the at least one application unit using the at least one nozzle; and h) moving the at least one nozzle relative to the at least one application unit to apply the $CO_2$ for cleaning purposes to a second surface of the at least one application unit using the at least one nozzle, wherein the at least one nozzle is moved relative to the at least one application unit to clean all surfaces of the at least one application unit.

* * * * *